US006557220B1

(12) United States Patent
Hamm, Jr.

(10) Patent No.: US 6,557,220 B1
(45) Date of Patent: May 6, 2003

(54) SECURITY CLUTCH WITH SELF-CENTERING SPRING

(75) Inventor: David H. Hamm, Jr., Rehoboth, MA (US)

(73) Assignee: B. A. Ballou & Co., Inc., East Providence, RI (US)

( * ) Notice: Subject to any disclaimer, the term of this patent is extended or adjusted under 35 U.S.C. 154(b) by 0 days.

(21) Appl. No.: 10/063,982

(22) Filed: May 31, 2002

(51) Int. Cl.[7] ..... A44C 7/00; A44B 21/00

(52) U.S. Cl. ..... 24/705; 24/499; 24/656; 24/658; 24/706.8; 63/12

(58) Field of Search ..... 24/705, 706.8, 24/656, 658, 633, 601.5, 499, 68 J; 63/12

(56) References Cited

U.S. PATENT DOCUMENTS

| | | | | |
|---|---|---|---|---|
| 966,544 A | | 8/1910 | Heaton | |
| 1,114,869 A | | 10/1914 | Donaldson | |
| 1,246,868 A | | 11/1917 | Bulley | |
| 1,277,258 A | | 8/1918 | Raiche | |
| 1,300,105 A | | 4/1919 | Arkin | |
| 1,402,827 A | | 1/1922 | Arkin | |
| 1,531,757 A | | 3/1925 | Rogers, Jr. | |
| 3,523,339 A | | 8/1970 | Viano | |
| 3,765,064 A | | 10/1973 | Hoober et al. | |
| 3,853,416 A | | 12/1974 | Hanan | |
| 3,948,547 A | | 4/1976 | Gache | |
| 4,184,343 A | | 1/1980 | Green | |
| 4,310,953 A | | 1/1982 | Nanasi | |
| 4,382,317 A | | 5/1983 | McDonald et al. | |
| 4,425,687 A | | 1/1984 | Sauer | |
| 4,881,302 A | | 11/1989 | Lee | |
| 5,309,737 A | * | 5/1994 | Fountoulakis | 63/12 |
| 5,529,379 A | | 6/1996 | Stocker | |
| 5,588,309 A | | 12/1996 | Chioffe | |
| 5,704,100 A | * | 1/1998 | Swan | 24/656 |
| 5,823,623 A | | 10/1998 | Beck | |
| 5,845,378 A | | 12/1998 | Karmeli et al. | |
| 5,894,641 A | | 4/1999 | Hurtz et al. | |
| 5,970,588 A | | 10/1999 | Hurtz et al. | |
| 5,983,669 A | | 11/1999 | Karmeli | |
| 6,138,333 A | * | 10/2000 | Hollingworth | 24/705 |
| 6,317,941 B1 | | 11/2001 | Hamm, Jr. | |
| 6,389,662 B1 | | 5/2002 | Hamm, Jr. | |

FOREIGN PATENT DOCUMENTS

| | | |
|---|---|---|
| FR | 1 101 261 | 4/1955 |
| FR | 1 155 521 | 12/1957 |
| FR | 2 385 351 | 4/1977 |
| FR | 2 474 838 | 2/1980 |

* cited by examiner

*Primary Examiner*—Victor Sakran
(74) *Attorney, Agent, or Firm*—Barlow, Josephs & Holmes, Ltd.

(57) ABSTRACT

A security clutch for a jewelry post with a circumferential groove includes a housing with a post receiving aperture extending therethrough and two access ports through a side wall. A pair of interlocking C-shaped lock members each include an inner free end that carries a lug anchor and an outer free end that serves as a trigger. The lug anchors are spring-biased by a spring toward one another to thereby urge the triggers outward through their respective access ports. The inner free ends are also urged toward one another by the forces of the spring to slidably reside in the post receiving aperture of the housing into locking engagement with the circumferential groove of the jewelry post residing in the post receiving aperture. The spring is serpentine in configuration and is routed from the lug anchor of one lock member to a first side of the inner wall of the housing to an opposite side of the inner wall of the housing back to the first side of the housing and then into communication with the lug of the other lock member. The serpentine configuration of the spring in communication with the inner wall of the housing enables the spring to be precisely centered in the housing thereby providing a precision and smooth operating security clutch for a jewelry post.

17 Claims, 7 Drawing Sheets

SECURITY CLUTCH WITH SELF-CENTERING SPRING

BACKGROUND OF INVENTION

The present invention relates to clutches and clasps and more particularly to a security clutch for a jewelry post, such as an earring post.

Security clutches or clasps are widely used for connection to a grooved jewelry post to secure the jewelry post in place. A jewelry post is commonly provided with an ornamented end and a free end. The ornamented end, for example, may carry a pearl, gemstones, metal cast design or other decorative structure. The opposing free end is inserted through a pierced ear. The free end of the post includes at least one circumferential groove to receive a clutch or clasp on the post on the opposite side of the ear to the ornamented end to secure the entire assembly in place on the ear. The clutch releasably engages the post and is of an enlarged area to prevent accidental removal of the post from the pierced ear. A security clutch can be removed and attached to the free end of the post for installation and removal of the earring assembly on the user's pierced ear. Additional circumferential grooves can also be provided to secure the clutch closer or farther away from the ornamented end in accordance with the thickness of the user's ear and their respective comfort level.

In view of the foregoing, the employment of a clasp or clutch to secure a jewelry post is critical so that it is does not fall out of the user's ear. Other non-earring jewelry posts have the same requirement. In the prior art, there have been many attempts to provide a security clutch for a grooved jewelry post. For example, the prior art includes various clutches with an integrated spring-biased locking member that obstructs a post receiving aperture positioned through the clutch. The integrated locking member typically includes a complex construction with many components and delicate springs.

Many prior art devices include two opposing trigger buttons to control the positioning of a locking member located inside the housing. Two trigger buttons are commonly needed to accommodate larger sized earring security clutches to ensure proper operation of the spring-biasing member contained within the security clutch body itself. However, it is common for these types of security clutches, particularly those with two triggers positioned on opposite side of the device from one another, to have inferior operation due to problems associated with the spring-biasing member contained within the security clutch body. For example, security clutches typically employ a leaf spring within the clutch body to spring-bias a member connected to the trigger to engage with the reduced neck portion of the grooved earring post. Two springs are respectively required for both the trigger members employed in the device. Due to the small size of the earring post and security clutch precision operation of the internal parts of the clutch, namely, the springs and triggers is essential to ensure smooth and proper operation of the clutch. In particular, centering of the spring members within the clutch is critical to such operation. If the internal components of clutch are not centered and precisely aligned, the user will not be able to smoothly insert and remove the grooved post or engage and disengage the clutch from the grooved earring post.

As a result, these prior art devices are expensive to manufacture and labor intensive to assemble. The delicate and complicated parts are very small in size and are very difficult to assemble properly with precision to ensure smooth and proper operation. Further, these prior art devices are difficult and cumbersome to operate by the user. In sum, these prior art devices are inadequate to meet the user's needs.

In view of the foregoing, there is a demand for an improved security clutch with a minimal number of component parts to facilitate manufacturing and assembly and to reduce cost without sacrificing quality and performance. There is a demand for a security clutch that has a construction that self-centers itself within the housing of the clutch to ensure smooth and proper operation thereof. There is also a demand for a security clutch that can install onto a standard grooved jewelry post. There is a further demand for a security clutch that is easy to operate, has a low profile for comfort with a positive lock.

SUMMARY OF INVENTION

The present invention preserves the advantages of prior art security clutches for jewelry posts. In addition, the security clutch for jewelry posts provides new advantages not found in currently known devices and overcomes many disadvantages of such currently available devices.

The invention is generally directed to the novel and unique security clutch for jewelry posts, such as grooved posts. A security clutch for a jewelry post includes a housing with a top plate and a bottom plate and a wall extending therebetween with an inner surface. The housing defines a post receiving aperture that extends through the top plate and the bottom plate. The housing includes first and second access ports. A first lock member is disposed in the housing and between the top plate and the bottom plate. The first trigger lock member includes a main body with an inner free end and an outer free end. A first trigger portion is connected to the outer free end of the first trigger lock member and extends through the wall through the first access port and is capable of manipulation outside the housing.

A first jewelry post engaging seat is connected to the inner free end of the of the first trigger lock member. A first lug is connected to and emanates from the inner free end of the main body of the first lock member. The first lug has an outer surface facing toward the first access port. A second lock member is disposed in the housing and between the top plate and the bottom plate where the second trigger lock member includes a main body with an inner free end and an outer free end. A second trigger portion is connected to the outer free end of the second trigger lock member and extending through the wall through the second access port and is capable of manipulation outside said housing. A second jewelry post engaging seat is connected to the inner free end of the of said second trigger lock member with a second lug connected to and emanating from the inner free end of the main body of the second lock member. The second lug has an outer surface that faces toward the second access port. The second lug of the second lock member slidably resides between the first boss and the first trigger portion and the first lug of the first lock member slidably residing between the second lug and the second trigger portion. A spring for spring-biasing the first lug toward the second lug is also provided.

In operation, the first main body and the second main body are movable relative to one another by depression of the first trigger portion and the second trigger portion against the biasing force of the spring from a resting locked position with the first jewelry post engaging seat and the second jewelry post engaging seat residing in the circumferential groove of the jewelry post thereby securing the jewelry post relative to said housing to an unlocked position with the first jewelry post engaging seat and the second jewelry post engaging seat being clear of the post receiving aperture thereby permitting free passage of the jewelry post within the post receiving aperture.

Accordingly, it is a primary object of the instant invention to provide a security clutch for jewelry posts.

Another object of the instant invention is to provide a security clutch for jewelry posts that can be easily installed and removed.

Still further, an object of the instant invention is to provide a security clutch for jewelry posts that securely locks to a grooved jewelry post.

It is yet another object of the present invention to provide a security clutch for jewelry posts that can be locked and unlocked by depression of a pair of trigger buttons.

A further object of the present invention is to provide a security clutch for jewelry posts that has a self-centering spring configuration to ensure smooth and precise operation of the clutch with fewer parts than prior art security clutches.

Another object of the present invention is to provide a security clutch for jewelry posts that is simple and easy to manufacture and assemble.

Yet a further object of the present invention is to provide a security clutch for jewelry posts that has a positive lock.

Another object of the present invention is to provide a security clutch for jewelry posts that can accommodate single and multiple grooved posts.

A further object of the present invention is to provide a security clutch for jewelry posts that has a low profile.

DETAILED DESCRIPTION

Figure 1:
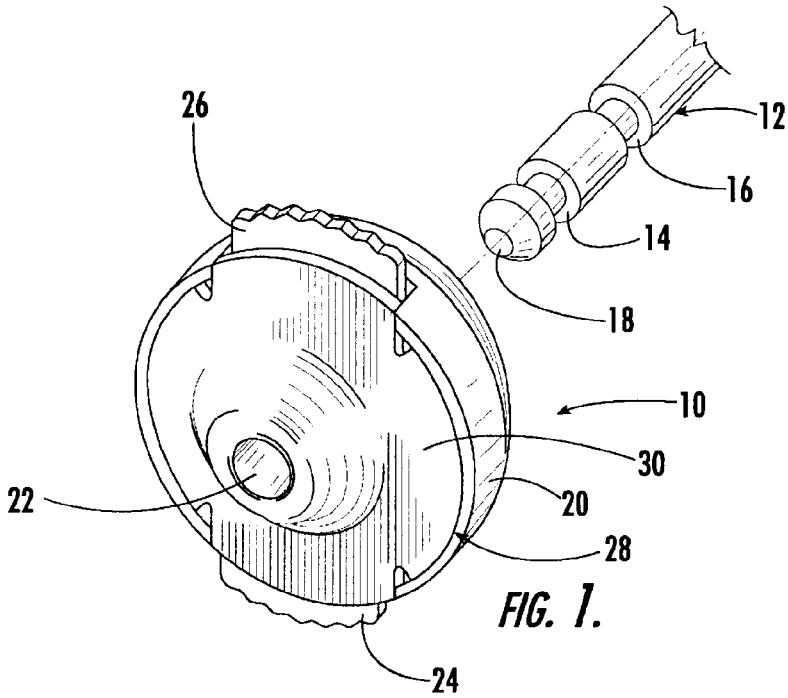
FIG. 1 is a perspective view of the security clutch of the preferred embodiment in the process of being installed on a multiple grooved jewelry post.

Referring first to FIG. 1, a security clutch 10 of the present invention is shown in the process of being installed on a grooved jewelry post 12. By way of example, the security clutch 10 of the present invention is shown for installation onto a double groove jewelry post 12 for an earring (not shown). It should be understood that the present invention may be used to secure to any type of jewelry post 12 for a wide array of jewelry applications.

Still referring to FIG. 1, the security clutch 10 can be attached to the shown double grooved jewelry post 12. In particular, the clutch 10 is shown being attached to the first groove 14 proximal to the end 18 of the post 12. The attachment of the security clutch 10 to the second groove 16 is identical to the attachment to the first groove 14 and need not be discussed in detail. The security clutch 10 can be secured to the free end 18 of the jewelry post 12.

Figure 2:
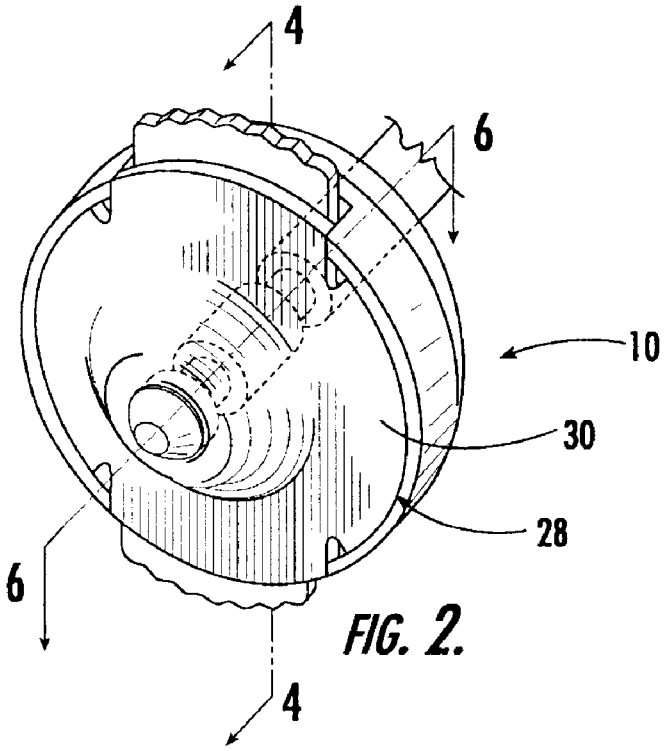
FIG. 2 is a perspective view of the security clutch of the present invention installed on a multiple grooved jewelry post.
Figure 3:
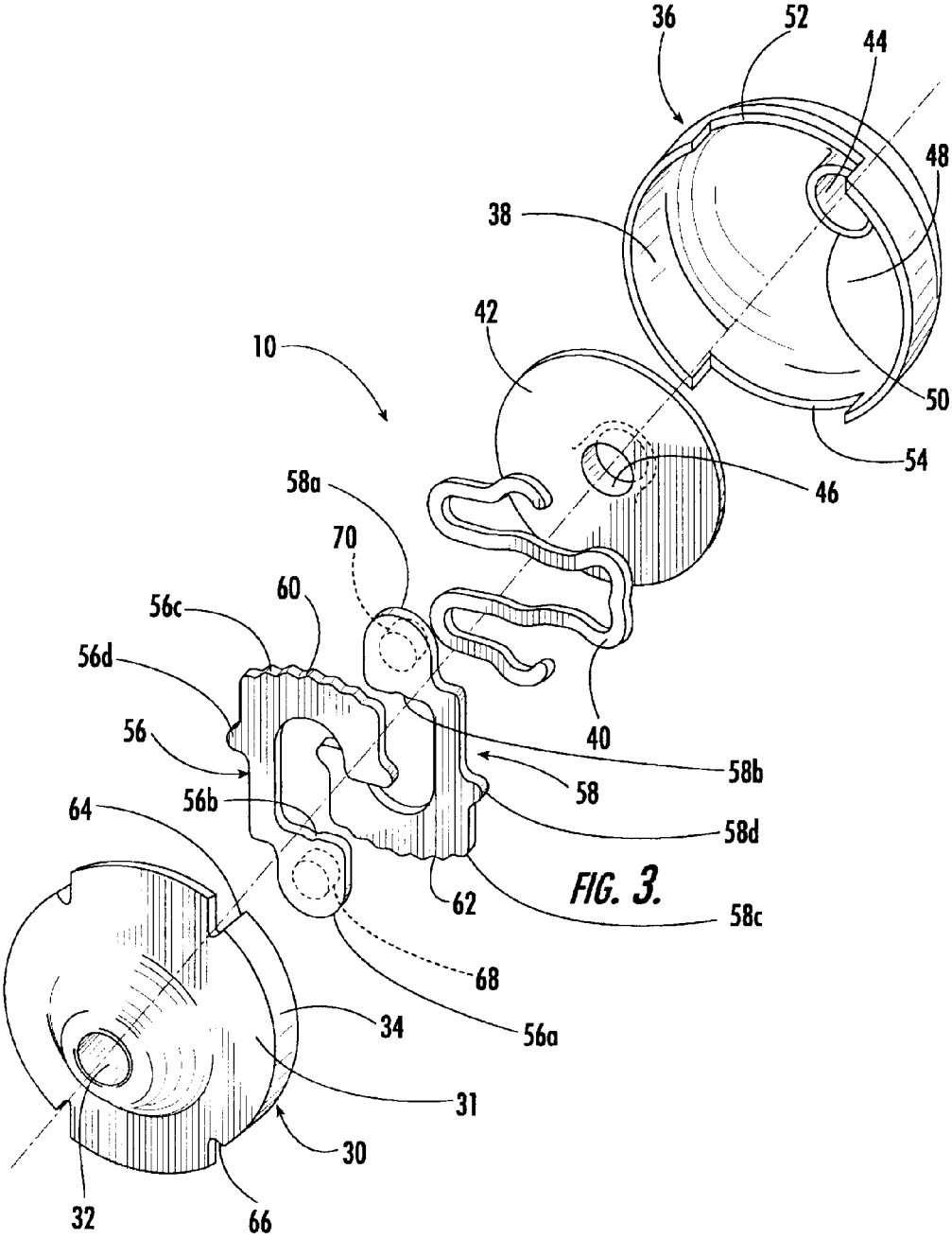
FIG. 3 is an exploded perspective view of the security clutch of the present invention.

FIGS. 2 and 3 show the security clutch 10 of the present invention installed on the free end 18 of the jewelry post 12. In FIGS. 1 and 2, the security clutch 10 of the present invention is shown to include an outer housing, generally referred to as 20, as well as a post receiving aperture, generally referred to as 22 and trigger buttons 24 and 26.

A lower housing shell 28 with a lower plate 30 and pass-through hole 32 and side wall 34 engages with the upper housing shell 36 so the side wall 34 of the lower housing shell 30 frictionally engages with the inner side of the downwardly depending wall 38 of the upper housing shell 36 in press-fit fashion. The upper housing shell 36 also includes a pass through aperture 44 Spring member 40 and washer 42, with aperture 46, are sealed within the housing 22 formed by the upper housing shell 36 and the lower housing shell 30. For simplicity, apertures 32, 44 and 46 are collectively referred to as a post-receiving aperture 22 when addressing the entire security clutch 10. Details of the construction and operation of the security clutch 10 of the preferred embodiment of the present invention will be shown below in connection with FIGS. 3–6.

Referring now to FIG. 3, an exploded perspective view of the security clutch 10 of the present invention is shown. The upper housing shell 36 is provided with a top plate 48 and a downwardly depending wall 38. A top boss 50 is provided with an upper post receiving aperture 44 positioned therethrough. A first notch 52 and a second notch 54 are provided in the downwardly depending wall 38 to serve as access ports. The washer 42, with pass-through hole 46, is preferably employed and positioned within the upper housing shell 36. The washer 42 is preferably used and necessary in most applications but may be omitted from the security clutch 10 for certain applications.

A unique self-centering spring member 40 is positioned adjacent to the washer 42 for stability and alignment normal to the axis through the post receiving aperture 22 which is illustrated in FIG. 1. A pair of C-shaped lock members 56 and 58 are positioned between the spring member 40 and the bottom plate 31 of the lower housing shell 30. Each of the C-shaped lock members 56 and 58 include trigger buttons 60, 62 on the outer free ends thereof which extend outwardly through respective cut-outs 52, 54 in the downwardly depending wall 38 and the cut-outs 64, 66 in the wall 34 of the lower housing shell 30. A pair of lugs 68, 70 are respectively connected to opposing respective inner free ends 56*a*, 58*a* of the C-shaped lock members 56, 58 to provide an anchor for receiving the spring member 40 thereon. The lugs 68, 70 preferably emanate perpendicularly upward from the top surfaces of the lock members 56, 58. However, other configurations may be provided on the inner free ends 56*a*, 58*a* of the lock members 56, 58 to receive the spring member 40 thereon. The inner free ends 56*a*, 58*a* of each of the lock members 56, 58, respectively include a seat 56*b*, 58*b* for engaging with a groove 14 or 16 of a jewelry post 12 to enable locking of the security clutch 10 thereon. These seats 56*b* and 58*b* are preferably arcuate or include a detent to receive the cylindrical shape of the grooves 14 or 16 of the earring post 12. The seats 56*b*, 58*b* may be of other configurations to suit the application.

Still further, the outer free ends 56*c*, 58*c* of each of the lock members 56, 58 respectively include a lateral shoulders

56*d,* 58*d* to provide a stop for contact with the inner walls 38, 34 of the housing shells 36, 30 to thereby prevent the entire lock members 56, 58 from exiting the housing 20 through their respective access ports 52, 64 and 54, 66.

Figure 4:
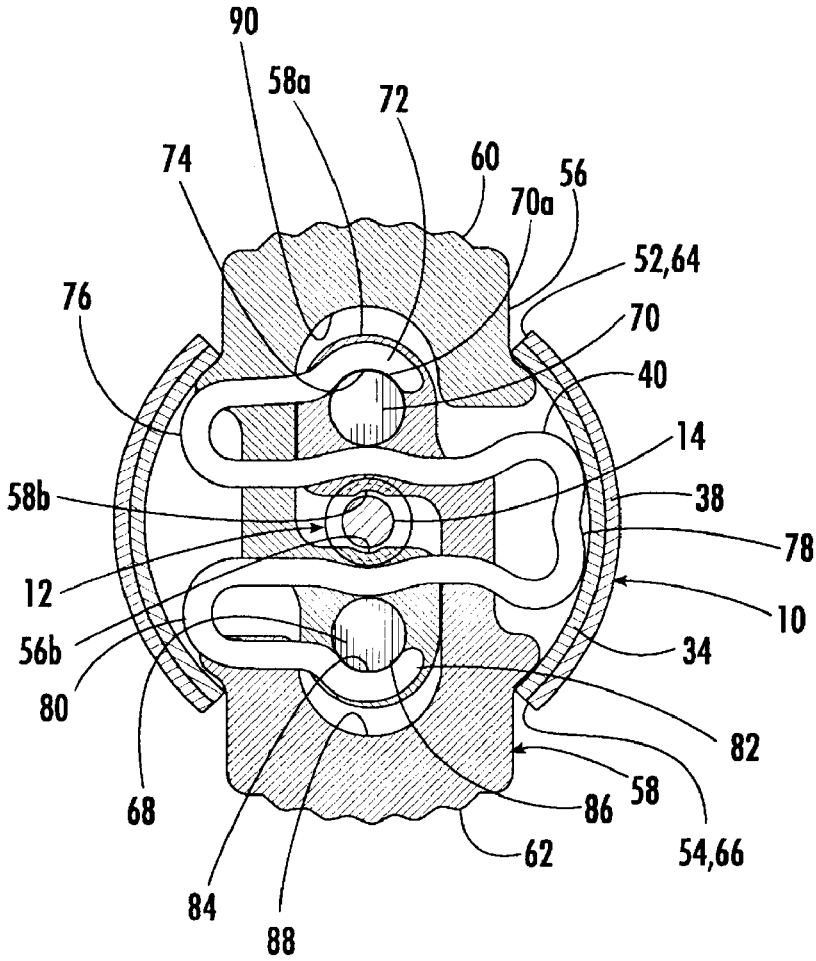
FIG. 4 is a cross-sectional view through the line 4—4 of FIG. 2 showing the security clutch in a locked position.

FIG. 4 illustrates the general arrangement of the components of the security clutch 10 of the present invention. The spring member 40 is serpentine in configuration in that it winds from one side of the housing 20 to the other and then back again. More specifically, a first free end 72 of the spring member 40 is connected to a lug 70 of the first lock member 58, namely, an arcuate portion 74 the spring member 40 embraces a top arcuate edge 70*a* of the lug 70 connected to the inner free end 58*a* of the first lock member 58. The spring member 40 then winds toward the inside surface of the wall of the housing 20, which is actually a double wall of the downwardly depending wall 38 of the top housing shell 36 and the upwardly depending wall 34 of the bottom housing shell 30. Subsequently, the spring member 40 turns back toward the center of the clutch 40 to form a first elbow 76 that is proximal to the wall 34, 38 of the housing shells 36, 30. The spring 40 passes between the lug 70 of the first lock member 58 and the post 12 to the opposing side of the housing shells 36, 30. At this point, the spring 40 bends back toward the center of the clutch to form a second elbow 78 that interfaces with the interior surface of the walls 38, 34 of the housing 20, namely, a side of the wall that is opposite to the side of the wall that is contacted by the first elbow 76 of the spring member 40. The spring member 40 is further routed between the second lug 69 on the second lock member 56 to the opposite side of the security clutch 10 proximal to the wall 38, 34 of the housing 20. The spring member 40 bends back toward the second lug 68 to form a third elbow 80. At the second free end 82 of the spring member 40, an arcuate contact surface 84 is provided for engagement with the outer surface 86 of the second lug 68 on the second lock member 56. Thus, the lock members 58, 56 are slidingly urged toward one another for locking.

Still referring to FIG. 4, the C-shaped lock members 56, 54 interlock with one another so that their respective free ends 58*a,* 56*a* that carry a lug 70, 68 thereon is nested within the adjacent lock member 58, 56. Each of the lock members 58, 56 include a channel 88, 90 to permit the end of the other lock member 58, 56 that carries the lug to freely slide therein. The arrangement and construction of the spring member 40 causes the lugs 70, 68 of the lock members 58, 56 to be drawn toward one another thus causing the respective triggers 62, 60 attached to the opposite ends thereof to be urged outward through their respective access ports 52, 64 and 54, 66 for easy manipulation by a user from outside the housing shell 20. The lateral shoulders 56*d* and 58*d* of each of the lock members 56 and 58 assists in centering the trigger portion 60 and 62 of the lock members 56 and 58 through its respective access port 54, 66 and 52, 64 and preventing the lock members 56 and 58 itself from exiting the housing 20 through its respective access ports 54, 66 and 52, 64.

Most importantly, the serpentine spring member 40 of the present invention not only provides the spring-biasing to control the movement of the lock members 56, 58 within the housing shell 20 but also serves to self-center the spring member 40 itself and the components connected thereto within the housing body 20. As can be seen in FIG. 4, the spring member 40 ensures that the lock members 56, 58 are properly aligned within the housing shell 20 with the assistance of the lateral shoulders 56*d* and 58*d* emanating from the lock members 56, 58.

Figure 5:
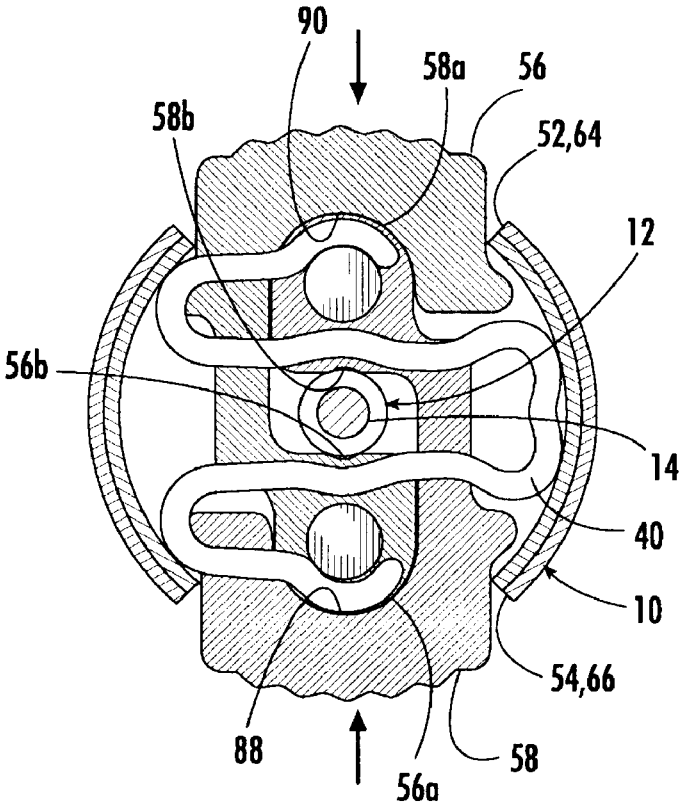
FIG. 5 is the cross-sectional view of the line 4—4 FIG. 4 showing the security clutch in an unlocked position with triggers depressed.
Figure 6:
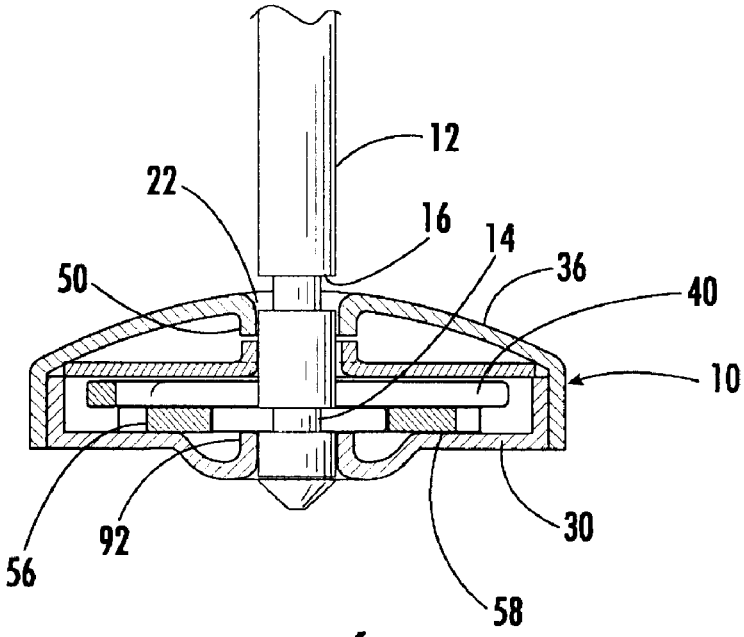
FIG. 6 is a partial cross-sectional view through the line 6—6 of FIG. 2.

Referring now to FIGS. 4–6, the construction and operation of the security clutch 10 of the preferred embodiment of the present invention is shown in more detail. For ease of illustration, the lower plate 31 of the lower housing shell 30 and washer 42 are not illustrated to permit clear view of the positioning of the spring member 40 and the lock members 56, 58 within the housing 20. In FIG. 4, the security clutch 10 is shown in a locked state and installed on a jewelry post 12. In this condition, the device is in a locked position. The spring 40 urges the two lugs 68 and 70 of the lock members 56, 58 to one another and toward the post receiving aperture 22 (not shown in FIGS. 4 and 5) so that the post receiving seats 56*b,* 58*b* of the C-shaped lock members 56, 58 reside within the post receiving aperture 22 and is engaged with one of the grooves 14 or 16 of post 12. During assembly, the spring member 40 is pulled apart slightly so that the free ends 72, 82 of the spring member 40 can seat onto their respective lugs 70, 68 on the lock members 58, 56. As a result, the necessary cross-tension is provided to cause the shoulders 56*d,* 58*d* of the lock members 56, 58 to seat on opposite side of the inner surface of the walls 34, 38 of the housing 20. As shown both in FIGS. 4 and 6, a grooved post 12 positioned within the post receiving aperture 22 receives the post receiving seats 56*b,* 58*b* within the groove 14 or 16 of the post 12 in a positive locking fashion so they can be secured in place by the spring-biasing of the spring member 40.

A double-grooved post 12 is shown in FIG. 6 as an example of the type of post that can be accommodated by the security clutch of the present invention. The clutch 10 is shown engaged with the top groove 14; however, the clutch 10 may be easily positioned on the lower groove 16 to suit the desired positioning of the clutch 10 on the post 12.

In this locked condition, the post receiving seats 56*b,* 58*b* of the lock members 56, 58, with the spring-biasing of the spring member 40. The lateral shoulders 56*d,* 58*d* make contact with the inner surface of the wall 34, 38 of the housing 20 to serve as a stop and to prevent over travel of the post receiving seats 56*b,* 58*b*. The triggers 60, 62 are preferably integrally connected to their respective lock members 56, 58 to protrude outside housing shell 20 through the access ports 54, 66 and 52, 64. A roughened surface is preferably provided on the exposed edges of the triggers 60, 62 for improved grip by the user when manipulating the triggers 60, 62.

In FIG. 5, the unlocking of the device 100 is shown. The triggers 60, 62 are depressed in, as shown by the indicated arrows, toward the post 12 to urge the post receiving seats 56*b,* 58*b* away from the post 12 against the spring-biasing forces of the spring member 40. As a result of the depression of triggers 60, 62, the inner free ends 56*a,* 58*a* of the C-shaped lock members 56, 58, namely, the arcuate post receiving seats 56*b,* 58*b,* are cleared from the post 12 to permit free travel of the post 12 in the post receiving aperture 22. The lock members 56, 58 slide within the corresponding channels 88, 90 of the other lock member 56, 58 so the rounded free ends 56*a,* 58*a* of the lock members 56, 58 nest within the arcuate channels 88, 90 of the lock members 56, 58. Such engagement of the rounded free ends 56*a,* 58*a* with the free end seats 88, 90 of the lock members 56, 58 serves as a stop to prevent over travel lock members 56, 58 during the unlocking process. Further, the lateral shoulders 56*d,* 58*d* of the lock members 56, 58 bear against opposite inner surfaces of the wall 34, 38 of the housing 20 to serve as a stop to prevent over travel of the lock members 56, 58 therein during the lock process.

In operation, to install the security clutch 10 of the present invention, the trigger portions 60, 62 are depressed to clear the post receiving aperture 22. A grooved post 12 is inserted into the post receiving aperture 22 with a groove 14 or 16 aligned with the security clutch 10. The triggers 60, 62 are released whereby the post receiving seats 56*b*, 58*b* of the lock members 56, 58 engage the groove 14 or 16 of the post 12 thus positively locking the clutch 10 to the post 12. To remove the clutch 10 from the post 12, the triggers 60, 62 are again depressed and the post 12 is removed from the cleared post receiving aperture 22.

Figure 7:
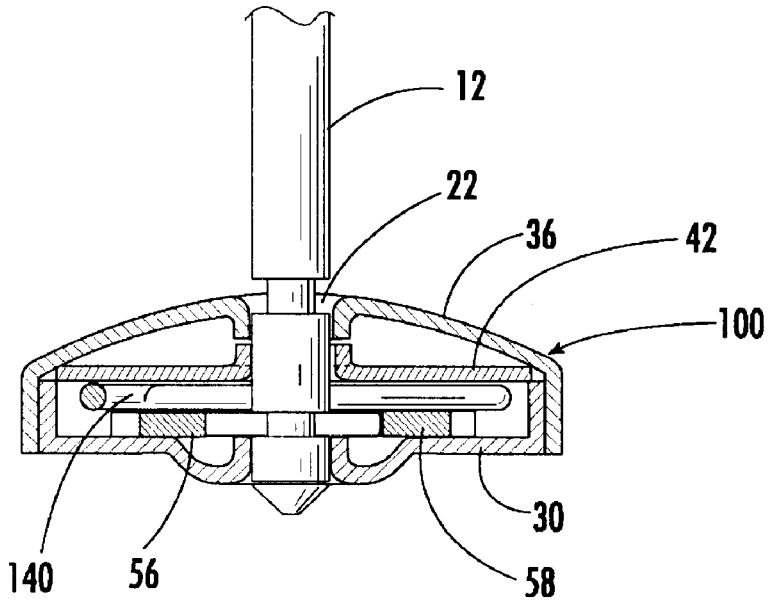
FIG. 7 is a partial cross-sectional view of an alternative embodiment of the security clutch of the present invention.

It is preferred that the components of the security clutch 10 of the present invention be manufactured of metal, such as ferrous and non-ferrous metal. For example, the spring member 40 is preferably heat treated 410 stamped stainless steel in a flat spring configuration. Alternatively, the spring member 40 may have a different cross-sectional configuration, such as bent metal wire 140, as shown in the alternative embodiment 100 of the invention in FIG. 7. Also, the washer 42 is, preferably, 302 stainless steel while all other components are preferably made of precious metal, such as gold. Other than the washer 122, the other components may also be platinum. However, other materials, such as plastic may be used to suit the application. It is also preferred that the triggers 60, 62 and their corresponding lock members 56, 58 travel as little as possible to facilitate operation. For example, the triggers 60, 62 preferably protrudes only 0.025 inches and travels only 0.008 inches to unlock.

It should understood that the construction of the upper housing shell 36 and lower housing shell 30 may be modified in accordance with the application at hand and still be within the scope of the present invention. For example, molded or cast housing may be employed instead of the preferred mating shell construction discussed above. Further, the washer 42 is provided for spacing and for maintaining the lock members 56, 58 in a plane that is normal to the axis of the post receiving aperture 22. Also, the washer 42 serves as a spacer to provide a flat supporting surface for the lock members 56, 58. As best seen in FIG. 6, a bottom boss 92 in the bottom housing 30 and a top boss 50 in the top housing 36 are employed to provide additional alignment and security of the post 12 received through the post receiving aperture 22 of the security clutch 10 of the present invention.

What is claimed is:

1. A security clutch for a jewelry post with a circumferential groove, comprising:

a housing including a top plate and a bottom plate and a wall extending therebetween with an inner surface; said housing defining a post receiving aperture extending through said top plate and said bottom plate; said wall defining a first access port and a second access port therethrough;

a first trigger lock member disposed in said housing and between said top plate and said bottom plate; said first trigger lock member including a main body with an inner free end and an outer free end; a first trigger portion connection to said outer free end of said first trigger lock member and extending through said wall through said first access port and capable of manipulation outside said housing;

a first jewelry post engaging seat connected to said inner free end of said first trigger lock member; a first lug connected to and emanating from said inner free end of said main body of said first lock member; said first lug having an outer surface facing toward said first access port;

a second trigger lock member disposed in said housing and between said top plate and said bottom plate; said second trigger lock member including a main body with an inner free end and an outer free end; a second trigger portion connected to said outer free end of said second trigger lock member and extending through said wall through said second access port and capable of manipulation outside said housing; a second jewelry post engaging seat connected to said inner free end of said second trigger lock member; a second lug connected to and emanating from said inner free end of said main body of said second lock member; said second lug having an outer surface facing toward said second access port;

said second lug of said second lock member slidably residing between said first boss and said first trigger portion and said first lug of said first lock member slidably residing between said second lug and said second trigger portion; means for spring-biasing said first lug toward said second lug; and said first main body and said second main body being movable relative to one another by depression of said first trigger portion and said second trigger portion against the biasing force of said means for biasing from a resting locked position with said first jewelry post engaging seat and said second jewelry post engaging seat residing in said circumferential groove of said jewelry post thereby securing said jewelry post relative to said housing to an unlocked position with said first jewelry post engaging seat and said second jewelry post engaging seat being clear of said post receiving aperture thereby permitting free passage of said jewelry post within said post receiving aperture.

2. The security clutch of claim 1, wherein said means for spring-biasing said first lug toward said second lug is a spring routed from said first lug to said second lug.

3. The security clutch of claim 2, wherein said spring is routed from said outer surface of said first lug to proximal to said inner surface of said wall and between said first lug and said post-receiving aperture and to said inner surface of said wall and between said post receiving aperture and said second lug and to proximal to said inner surface of said wall to an outer surface of said second lug.

4. The security clutch of claim 1, wherein said housing further includes a bottom shell and a top shell mated together.

5. The security clutch of claim 1, further comprising: a washer, with a washer aperture therethrough, disposed between said first and second lock members and said top plate; said washer aperture being coaxial with said post receiving aperture.

6. The security clutch of claim 1, further comprising: a bottom boss emanating upwardly from said bottom plate and surrounding said post receiving aperture through said bottom plate.

7. The security clutch of claim 1, further comprising: a top boss emanating downwardly from said top plate and surrounding said post receiving aperture through said top plate.

8. The security clutch of claim 4, wherein said housing, said first lock member, said second lock member, said biasing member and said washer are manufactured of metal.

9. The security clutch of claim 1, wherein said housing, said first lock member, said second lock member and said biasing member are manufactured of gold.

10. The security clutch of claim 4, wherein said washer is manufactured of stainless steel.

11. A security clutch for a jewelry post with a circumferential groove, comprising:

a housing including a top plate and a bottom plate and a wall extending therebetween with an inner surface; said housing defining a post receiving aperture extending through said top plate and said bottom plate; said wall defining a first access port and a second access port therethrough;

a first C-shaped lock member having an inner free end and an outer free end; said outer free end of said first C-shaped lock member being a first trigger and extended through said first access port; a first lug emanating from and connected to said inner free end of said first C-shaped lock member providing a first anchor member; said inner free end of said first C-shaped lock member being movable into communication with said post receiving aperture;

a second C-shaped lock member having an inner free end and an outer free end; said outer free end of said second C-shaped lock member being a second trigger and extended through said second access port; a second lug emanating from and connected to said inner free end of said second C-shaped lock member providing a second anchor member; said inner free end of said second C-shaped lock member being movable into communication with said post receiving aperture; and means for spring-biasing said first anchor toward said second anchor and urging said inner free end of said first C-shaped lock member and said inner free end of said C-shaped lock member into locking engagement with a circumferential groove of a jewelry post residing in said post receiving aperture.

12. The security clutch of claim 10, wherein said means for spring-biasing is a spring routed from said first lug to said second lug.

13. The security clutch of claim 10, wherein said housing further includes a bottom shell and a top shell mated together.

14. The security clutch of claim 10, further comprising: a washer, with a washer aperture therethrough, disposed between said first and second C-shaped lock members and said top plate; said washer aperture being coaxial with said post receiving aperture.

15. The security clutch of claim 13, wherein said housing, said first C-shaped lock member, said second C-shaped lock member, said means for biasing and said washer are manufactured of metal.

16. The security clutch of claim 10, wherein said housing, said first C-shaped lock member, said C-shaped second lock member and said means for biasing are manufactured of gold.

17. The security clutch of claim 13, wherein said washer is manufactured of stainless steel.

* * * * *